United States Patent [19]

Walworth

[11] 4,359,526

[45] Nov. 16, 1982

[54] METHOD FOR FORMING A PHOTOSENSITIVE SILVER HALIDE ELEMENT

[75] Inventor: Vivian K. Walworth, Concord, Mass.

[73] Assignee: Polaroid Corporation, Cambridge, Mass.

[21] Appl. No.: 298,637

[22] Filed: Sep. 2, 1981

[51] Int. Cl.[3] ..... G03C 1/76; G03C 1/02

[52] U.S. Cl. ..... 430/568; 430/564; 430/567; 430/569; 430/496; 430/523; 430/935; 430/948; 430/961

[58] Field of Search ..... 430/564, 567, 568, 569, 430/935, 496, 523, 948, 641, 643, 11, 13, 961

[56] References Cited

FOREIGN PATENT DOCUMENTS

WO80/01614 8/1980 PCT Int'l Appl.

OTHER PUBLICATIONS

Duffin, *Photographic Emulsion Chemistry,* 1966, p. 59.

James, The Theory of the Photographic Process, 4th Edition, 1977, p. 89.

*Primary Examiner*—Mary F. Downey

*Attorney, Agent, or Firm*—Philip G. Kiely

[57] ABSTRACT

A method for forming a photosensitive element comprising a plurality of single effective silver halide grains in a predetermined spaced array which comprises coalescing a fine-grain silver halide emulsion in a plurality of predetermined spaced depressions in a surface, wherein said coalescence is carried out by contacting said fine-grain emulsion with a silver halide solvent in the vapor phase.

19 Claims, 3 Drawing Figures

1μm

METHOD FOR FORMING A PHOTOSENSITIVE SILVER HALIDE ELEMENT

BACKGROUND OF THE INVENTION

In the formation of photosensitive silver halide emulsions, the ripening or growing step during which time the silver halide grains grow is considered important. During the ripening stage an adequate concentration of a silver halide solvent, for example, excess halide, generally bromide, is employed which renders the silver halide much more soluble than it is in pure water because of the formation of complex ions. This facilitates the growth of the silver halide grains. While excess bromide and ammonia are the most common ripening agents, the literature also mentions the use of water-soluble thiocyanate compounds in place of bromide as well as a variety of amines. See, for example, *Photographic Emulsion Chemistry*, G. F. Duffin, The Focal Press, London, 1966, page 59.

With respect to ammonia as a ripening agent, *The Theory of the Photographic Process*, T. H. James, Fourth Edition, MacMillan Publishing Co., Inc. New York, 1977, on page 89, states:

"On the basis of the mode of precipitation, there are two classes of emulsions: neutral or acid emulsions and ammoniacal emulsions. In the first class, alkali halide is dissolved in water containing the peptizing gelatin, and to this solution is added, under controlled conditions, the desired amount of silver nitrate solution; or the alkali halide and silver nitrate solutions are added simultaneously to the gelatin solution. A large excess of alkali halide may be used to promote physical ripening, and such ripening is increased by higher temperature and longer time of action. Ammoniacal emulsions are prepared by adding ammonium hydroxide during precipitation and/or ripening. Ammonia, because of its solvent action, accelerates physical ripening. The ammonia may be added to the halide solution or the silver nitrate solution may be converted by ammonium hydroxide to the silver/ammonia complex, which is then added to the halide solution. Upon reaction with halide, ammonia is released and the silver halide is precipitated and undergoes ripening."

Copending application of Edwin H. Land, Ser. No. 234,937, filed Feb. 17, 1981, (common assignee) is directed to a method for forming a predetermined spaced array of sites and then forming single effective silver halide grains at said sites. Thus, by forming the sites in a predetermined spatial relationship, if the silver halide grains are formed only at the sites, each of the grains will also be located at a predetermined and substantially uniform distance from the next adjacent grain and their geometric layout will conform to the original configuration of the sites.

The term, "single effective silver halide grain", refers to an entity at each site which functions photographically as a single unit which may or may not be crystallographically a single crystal but one in which the entire unit can participate in electronic and ionic processes such as latent image formation and development.

Copending application Ser. No. 234,937 discloses one method for forming sites by exposing a photosensitive material to radiation actinic to said photosensitive material and developing the so-exposed photosensitive material to provide sites for the generation of silver halide corresponding to the pattern of exposure and then forming photosensitive silver halide grains at the sites. In a preferred embodiment, the sites are provided by the predetermined patterned exposure of the photoresist whereby upon development of an exposed photoresist a relief pattern is obtained wherein the peaks or valleys comprise the above described sites.

Preferably, the photoresist is exposed by interfering coherent radiation in order to provide sites with a desired spacing therebetween. Thus, exposure of the photoresist can be carried out by two interfering coherent beams wherein the beams providing the exposures are at an angle to each other. The intersection of maximum intensities of the two combined exposures will provide a greater degree of modifications to the photoresist at the points of intersection than the remainder of the photosensitive material.

Preferably, the source of coherent radiation is a laser. The particular laser will be selected depending upon the absorption spectrum and spectral response characteristics of the specific photoresist employed.

Subsequent to exposure of the photoresist, the relief pattern is formed by developing the exposed photoresist. For example, employing a photoresist wherein solubilization is achieved by exposure, development of the exposed photoresist would result in the removal of selected areas to provide a relief pattern consisting of regular depressions or holes in the photoresist. As disclosed in copending application Ser. No. 234,937, a variety of specific relief configurations can be obtained depending upon the specific material employed and the exposure and developing conditions selected. Copending application of James J. Cowan, Arthur M. Gerber and Warren D. Slafer, Ser. No. 234,959 filed, Feb. 17, 1981 also discloses and claims methods for producing specific relief patterns.

While the single effective silver halide grains may be formed employing the described photoresist relief pattern, it is preferred to replicate the relief pattern by conventional means, for example, by using conventional electroforming techniques to form an embossing master from the original relief image and using the embossing master to replicate the developed photoresist pattern in an embossable polymeric material.

Having produced the described relief pattern, silver halide grains are then formed by a variety of disclosed procedures at the specific sites.

Copending application of Arthur M. Gerber, Ser. No. 298,640, filed concurrently herewith (common assignee), discloses and claims the formation of single effective grains in a predetermined spaced array by coalescing fine-grain silver halide in a plurality of predetermined spaced depressions in a surface. A preferred method of coalescence comprises contacting the fine-grain emulsion with a solution of a silver halide solvent.

By means of the present invention, a novel method for forming a predetermined spaced array of silver halide grains in a relief pattern has been found.

SUMMARY OF THE INVENTION

The present invention is directed to a method for forming a photosensitive element comprising a plurality of single effective silver halide grains in a predetermined spaced array which comprises coalescing a fine-grain silver halide emulsion in a plurality of predetermined spaced depressions in a surface to provide a single effective silver halide grain in each depression by contacting said fine-grain emulsion with a silver halide solvent in the vapor phase.

DETAILED DESCRIPTION OF THE INVENTION

Figure 1:
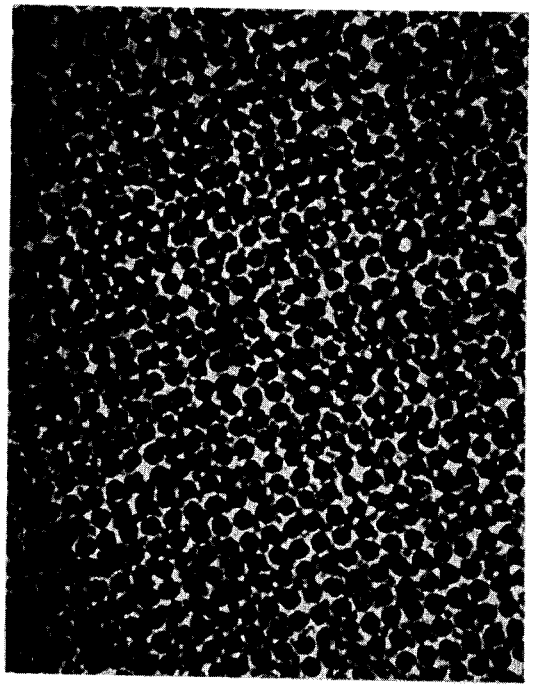
FIG. 1 is an electron micrograph of an element prepared by the method of the present invention.

Copending application Ser. No. 234,937 is directed to photosensitive elements comprising single effective silver halide grains in a predetermined spaced array and methods for preparing such photosensitive elements. The present invention involves a novel method for forming such a photosensitive element.

The aforementioned predetermined spaced depressions in a surface comprise a relief pattern which may be formed by the procedures set forth in copending applications Ser. Nos. 234,937 and 234,959, which, in one procedure, provides for coherent light to provide in a photoresist selective solubilization which, upon development of the photoresist, will result in a preselected relief pattern of depressions or cup-like formations in a substantially planar surface which may then be replicated by the described procedures. The silver halide grains will be formed in each of these depressions and, since the depressions were formed in a predetermined pattern, the resulting silver halide grains will also be arrayed in the same pattern.

A fine-grain silver halide emulsion is applied to the embossed surface of the polymeric layer in a manner that results in substantially all of the applied emulsion being contained in the aforementioned depressions with little being located on the planar or plateau-like surface between the depressions. Any fine-grain emulsion remaining on the planar surface subsequent to coalescence is photographically insignificant compared to the silver halide grains formed in the depressions.

The term, "fine-grain emulsion", as used herein is intended to refer to a silver halide emulsion containing grains the size of which would permit a number of grains to be deposited within each depression and also sufficiently small to substantially conform to the contours of the depressions. Preferably, a silver halide emulsion containing grains between about 0.01 and 0.50 μm in diameter is employed. Particularly preferred is a silver halide emulsion having grains with an average diameter of about 0.1 μm or less.

Since the silver halide grains must be kept in suspension prior to depositing them in the depressions, there is a polymeric binder material, generally gelatin, also present. It is preferred that the binder to silver ratio be relatively low since an excessive amount of binder such as gelatin may slow or inhibit the subsequent single grain formation. In addition, excessive binder would occupy space in the depressions that could be taken by silver halide grains or silver halide solvent. Preferably, the gel to silver ratio is about 0.1 or less and more preferably about 0.075. It is also preferred that the fine-grain emulsion be dried in the depressions prior to the coalescence step.

As described in copending application Ser. No. 298,640, subsequent to the deposition of fine-grain silver halide in the depressions, coalescence of the grains into a single effective silver halide grain is accomplished, preferably by the application of a solution of a silver halide solvent so that in each depression there occurs a partial dissolution of the emulsion. Coalescence is accelerated by the application of heat. Subsequent to coalescence a cooling step and washing step to remove excess salts are preferably employed.

It has now been found that coalescence can be carried out by contacting the fine-grain emulsion with a silver halide solvent in the vapor phase. The method of the present invention is a simplified procedure that does not require washing steps, since no salt-containing solutions that would require subsequent removal are applied. It will also be seen that, since no liquid solution is applied during coalescence, the grains are not subject to being dislodged from the depressions, and therefore essentially no silver is lost in the course of the coalescence. If desired, the fine-grain emulsion may be prewet prior to the coalescence step. If desired, a washing step, subsequent to single effective grain formation may be carried out to assist in dissipating the silver halide solvent vapor.

In order to provide the vapor phase, a solution of the silver halide solvent is maintained at a temperature, pressure and concentration necessary to provide a vapor pressure of the solvent to which the emulsion coated embossed base is exposed for a time sufficient to cause coalescence of the fine-grain emulsion into single effective grains. Because of the ease of obtaining it in the vapor phase, ammonia is the preferred silver halide solvent.

In a preferred embodiment, a polymeric overlayer, e.g., a layer of gelatin, is coated over the fine-grain emulsion in the embossed base in order to modulate the contact of the emulsion with the vapor. Thus, by diffusing the vapor through the polymeric overlayer, a more uniform and more controlled exposure of the silver halide to the vapor is achieved.

Any suitable volatile silver halide solvent known to the art and combinations thereof may be employed in the practice of the present invention. As examples of such solvents, mention organic silver complexing agents, such as ethylene diamine, triethylamine and higher amines.

After coalescence, a relief pattern containing a predetermined spaced array of depressions, each carrying a single effective silver halide grain, is obtained. If desired, the single effective silver halide grains may be treated to remove any residual silver halide solvent by evaporation or washing.

A comparison of silver coverages of the initially deposited fine-grain emulsion and the final single effective silver halide grains show that substantially all the silver initially deposited remains after carrying out the procedure of the present invention.

The following Example illustrates the novel process of the present invention.

EXAMPLE 1

A fine-grain photosensitive silver iodobromide emulsion (4 mole % I, gelatin/Ag ratio of 0.075, grain diameter about 0.1 μm) was slot-coated onto a polyester base carrying a layer of cellulose acetate butyrate embossed with depressions about 1.8 μm in diameter, depth about 1 μm and center-to-center spacing of about 2.2 μm to provide a silver coverage of about 80 mg/ft$^2$. The emulsion contained a combination of AEROSOL OT (dioctyl ester of sodium sulfosuccinic acid) American Cyanamid Co., Wayne, N.J., and MIRANOL J2M-SF (dicarboxcyclic caprylic derivative sodium salt) Miranol Chemical Col, Inc., Irvington, N.J., in a 1 to 3 ratio by weight, respectively, at about a 0.1% concentration by weight, based on the weight of the emulsion. The emulsion was overcoated with a 4% gelatin solution using a #4 wire wound rod (R.D. Specialties Co., Webster, N.Y.).

Figure 2:
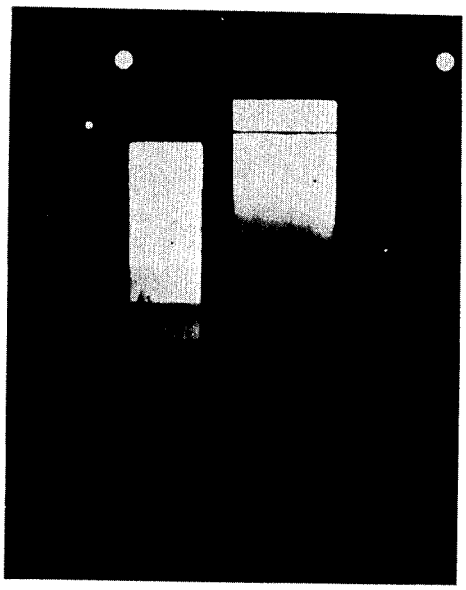
FIG. 2 is a positive image of a step tablet and a continuous wedge obtained from an exposed and processed element of the present invention.

The emulsion-coated embossed base was exposed to ammonia from an ammonium hydroxide solution (pH 12.4) at 37° C. for 1 min. after which residual ammonia was evaporated from the emulsion-coated embossed base. FIG. 1 is an electron micrograph at 1,600×magnification showing the thus-formed grains. The emulsion was then exposed to a step tablet and continuous wedge at 2 mcs and processed with a Type 42 processing composition and Type 107C receiving sheet (Polaroid Corp., Cambridge, Mass.). The positive silver transfer image of the step tablet and continuous wedge is shown in FIG. 2.

EXAMPLE 2

Figure 3:
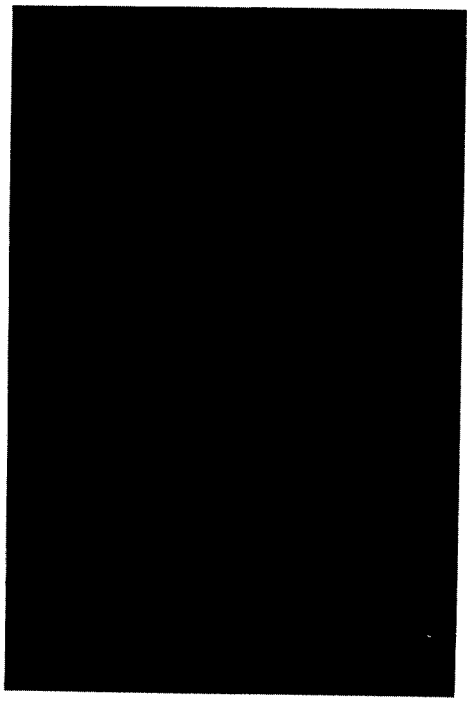
FIG. 3 is a positive image of a step tablet and a continuous wedge obtained from a control for comparison with FIG. 2.

For comparison, a sample of the same emulsion coated embossed base, without having been exposed to the ammonia treatment, was exposed and processed in the same manner as in Example 1. FIG. 3 shows the photographic results after processing. The total lack of a positive image at this exposure level (2 mcs) shows that, since no coalescence was carried out, the fine-grain silver halide emulsion without coalescence showed substantially no visible photographic response, whereas, following coalescence of the same emulsion, as shown in Example 1, a significant photographic response is achieved.

The photographic element of the present invention may be chemically sensitized by conventional sensitizing agents known to the art and which may be applied at substantially any stage of the process, e.g., subsequent to coalescence and prior to spectral sensitization.

Preferably, spectral sensitization of the photosensitive elements of the present invention may be achieved by applying a solution of a spectral sensitizing dye to the thus-formed single effective silver halide grains. This is accomplished by applying a solution of a desired spectral sensitizing dye to the finished element. However, the sensitizing dye may be added at any point during the process, including with the fine-grain emulsion or silver halide solvent solution. In a preferred embodiment, the spectral sensitizing dye solution contains a polymeric binder material, preferably gelatin.

Additional optional additives, such as coating aids, hardeners, viscosity-increasing agents, stabilizers, preservatives, and the like, also may be incorporated in the emulsion formulation.

What is claimed is:

1. A method for forming a photosensitive element comprising a plurality of single effective silver halide grains in a predetermined spaced array which comprises coalescing a fine-grain silver halide emulsion in a plurality of predetermined spaced depressions in a surface by contacting said fine-grain emulsion with a silver halide solvent in the vapor phase.

2. The method of claim 1 wherein said spaced depressions are in a substantially planar surface.

3. The method of claim 1 which includes the step of depositing said fine-grain emulsion in said spaced depressions.

4. The method of claim 3 wherein said fine-grain emulsion comprises silver halide grains about 0.01 to 0.50 μm in average diameter.

5. The method of claim 4 wherein said fine-grain emulsion comprises grains about 0.1 μm or less in diameter.

6. The method of claim 1 wherein said fine-grain emulsion has a binder to silver ratio of about 0.1 or less.

7. The method of claim 6 wherein said binder to silver ratio is about 0.075.

8. The method of claim 1 wherein said silver halide solvent is ammonia.

9. A method for forming a photosensitive element comprising a plurality of single effective silver halide grains in a predetermined spaced array which comprises the following steps in sequence:

(a) depositing a fine-grain silver halide emulsion in a plurality of predetermined spaced depressions in a surface;

(b) contacting said fine-grain emulsion with a silver halide solvent in the vapor phase for a time sufficient to partially dissolve said grains in each depression; and (c) coalescing said grains to a single effective silver halide grain in substantially each depression.

10. The method of claim 9 wherein said fine-grain emulsion comprises silver halide grains about 0.01 to 0.50 μm in average diameter.

11. The method of claim 10 wherein said fine-grain emulsion comprises grains about 0.1 μm or less in diameter.

12. The method of claim 9 wherein said fine-grain emulsion has a binder to silver ratio of about 0.1 or less.

13. The method of claim 12 wherein said binder to silver ratio is about 0.075.

14. The method of claim 9 wherein said silver solvent is ammonia.

15. The method of claim 9 which includes the step of washing said single effective grains.

16. The method of claim 9 which includes the step of chemically sensitizing said single effective grains.

17. The method of claim 9 which includes the step of spectrally sensitizing said single effective silver halide grains.

18. The method of claim 9 which includes applying a polymeric material over said fine-grain emulsion prior to contact with said silver halide solvent.

19. The method of claim 18 wherein said polymeric material is gelatin.

* * * * *